United States Patent [19]

Hiser

[11] 4,129,114

[45] Dec. 12, 1978

[54] FIREPLACE-FURNACE SYSTEM

[75] Inventor: William H. Hiser, Bartonville, Ill.

[73] Assignee: Lighthouse Fireplaces, Inc., Bartonville, Ill.

[21] Appl. No.: 729,002

[22] Filed: Oct. 4, 1976

[51] Int. Cl.[2] ..... F24B 7/04

[52] U.S. Cl. ..... 126/122; 126/121

[58] Field of Search ..... 126/121, 122, 129, 140, 126/141, 142, 143, 202; 237/51

[56] References Cited

U.S. PATENT DOCUMENTS

| | | | |
|---|---|---|---|
| 1,526,791 | 2/1925 | Johnson | 126/121 |
| 2,429,748 | 10/1947 | Dollinger | 126/121 |
| 2,484,292 | 10/1949 | Hermanson | 126/121 |
| 2,671,440 | 3/1954 | Dupler | 126/140 X |
| 3,834,619 | 9/1974 | Glover | 126/121 |
| 3,913,558 | 10/1975 | Caldwell | 126/140 X |
| 3,994,275 | 11/1976 | Williams | 126/141 |
| 3,999,535 | 12/1976 | Hall | 126/121 |
| 4,004,731 | 1/1972 | Zung | 126/121 X |

FOREIGN PATENT DOCUMENTS

| | | | |
|---|---|---|---|
| 18655 | 12/1904 | Fed. Rep. of Germany | 126/129 |
| 2288946 | 5/1976 | France | 126/121 |
| 335557 | 2/1959 | Switzerland | 126/121 |
| 374444 | 6/1932 | United Kingdom | 126/121 |

*Primary Examiner*—William F. O'Dea
*Assistant Examiner*—Harold Joyce
*Attorney, Agent, or Firm*—Dressler, Goldsmith, Clement, Gordon & Shore, Ltd.

[57] ABSTRACT

A self-contained fireplace and circulating air unit for installation in a building living area which includes a combustion system and an air circulating system. The combustion system includes a fireplace having an open top for exhaust of combustion products and a heat exchanger positioned to intercept the combustion products. The circulating system includes circulating air ducts in communication with the heat exchanger and a blower for circulating air through the ducts and the heat exchanger and through duct work in the building in which the unit is installed.

20 Claims, 8 Drawing Figures

5
74
76
72
80
55
42
76a
76b
90
50
79
92
79
68
64
62
44
66
114
110
20
12
14
24
16
100
46
48
30
26
28
5

72
76
76
35
40
42
80
40
34
38
78
88
38
82
78
82
32
55
84
55
32
76a
76a
6.
76b
60
90
76b
6.
50
79
92
79
126
126
18
62
12
114
22
22
114
20
7.
24
14
7.
46
48
16
26
30
30

35'
104
76
76
42
80
82
34'
38
78
78
55
32
32
82
106
76a
76a
50
76b
76b
50
60
79
62
32
32
12
22
20
22
24
14
46
48
104
16
102
30
30
26

FIREPLACE-FURNACE SYSTEM

BACKGROUND OF THE INVENTION

The present invention relates to self-contained combination fireplace-furnace systems adapted for installation in the living space of a building.

While existing types of fireplaces provide heat, their primary use in most cases is an esthetic one. The inability of a fireplace to heat the room in which they are located efficiently is well known. For example, heat is dissipated within the fireplace itself and is lost up the chimney. The result is an inefficient use of fuel.

A variety of approaches have been taken in an attempt to improve the heat transfer characteristics of fireplaces, including the use of fireplace structures as part of or as an auxiliary to separate forced air heating systems.

For example, in Mouat, U.S. Pat. No. 3,685,506, Andrews U.S. Pat. No. 3,762,391, and Wilkening U.S. Pat. No. 3,845,754, the structures surrounding the fire box of the fireplace are adapted to provide air circulation for heating the air and directing the air into the room in which the fireplace is located. A similar modification of a built-in fireplace is disclosed in the March, 1976 Popular Science Magazine, pages 111 and 153. Another type of such a fireplace is marketed by the Majestic Company of Huntington, Ind. under the trademark MAJESTITHERM.

Alternatively, other approaches have attempted to combine fireplaces with forced air furnace systems by using the fireplace in part to heat air within the forced air system, or by introducing air heated in the fireplace into the forced air system. Examples of such systems are disclosed in Stein U.S. Pat. No. 2,572,888 and in Glover U.S. Pat. No. 3,834,619.

Such systems are deficient and not totally satisfactory. They are either limited to attempted improvements in distribution of heat from the fireplace into the room in which the fireplace is located, or require a separate furnace forced air system for heating areas in the building other than the one in which the unit is located. The practicality of such combined systems is questionable.

Furthermore, attempts to interface a fireplace with an independent forced air system require the existence of both systems and limit the possible uses of such to structures which can be adapted to accommodate both. Many structures can not.

SUMMARY OF THE INVENTION

In accordance with the present invention there is provided a unit in the form of a fireplace adapted for installation in a living space within a building, which is also a self-contained forced air furnace. The self-contained unit of the present invention provides forced air heating of the building in which it is disposed when heating is desired, and may function as an air conditioner during the hot weather.

A self-contained fireplace-furnace unit in accordance with the present invention incorporates all of the decorative and operative components of a fireplace, a forced air furnace and an air conditioner. It is designed for installation within a living space without extensive structural modifications to the building.

A fireplace-furnace unit incorporating the present invention is highly decorative, and may be installed in each apartment of an apartment building, or other multiple dwellings, to provide each residence within the building with a self-contained heating and cooling system in the form of a decorative fireplace capable of solid fuel combustion.

The fireplace-furnace unit incorporating the present invention may be flush mounted against a wall of the building or may be partially recessed within the wall. In either case, the design of the unit itself fully insulates the unit from the surrounding environment. At the same time, relatively lightweight sheet metal can be used in construction of such unit, thus eliminating the need of significant structural modifications to or reinforcement of the building.

More specifically, in one embodiment of the self-contained fireplace-furnace of the present invention incorporates a combustion system including a fireplace having a fire box and an exhaust duct for connection to an exhaust flue and chimney. The firebase may form part of a raised hearth supported by a support base which can rest on the floor of the structure or be recessed into the floor as design of the building may allow. The exhaust duct is disposed above the fire box and incorporates a heat exchanger heated by a solid fuel in the fire box and/or by supplemental heaters disposed immediately adjacent to the heat exchanger.

An air circulating system functionally isolated from the combustion system incorporates a pair of circulating air ducts which extend along either side of the fire box to provide an air space insulating the fire box from the surrounding environment. The two air ducts are in communication with the heat exchanger for distribution of air heated in the heat exchanger into the air ducting forming part of the building in which the unit is located.

For the hot weather months, air conditioning can be provided by an air cooling coil disposed within the air circulating system. The condensor and compressor components of the air conditioner may be disposed within the unit or, if desired, at some other convenient location.

The air spaces around the fire box provide thermal insulation from the surrounding environment. Air can be circulated through these spaces to improve the thermal insulation of the unit, and may be used to cool a condensor that can be located in these spaces. This air flow may facilitate and assist exhaust of the combustion gases from the unit.

Alternatively, supplemental heaters, e.g. electric heaters, may be incorporated directly in the air circulating system within the unit.

A decorative removable hood encloses components disposed above the fire box. The back of the fire box is provided with a reflective surface, not only to accentuate and brighten a fire in the fireplace, but to improve the heat radiation of the fireplace. The decor of the unit may be enhanced by tinted glass doors, spring loaded for shock resistance and easily removed for cleaning or replacement.

Combustion may be controlled by utilization of a source of combustion air externally of the room in which the unit is located, operated either manually or thermostatically, to control the degree and rate of combustion.

Thus, the fireplace-furnace of the present invention is self-contained, is capable of providing all of the heating and cooling functions normally attributable to a forced air furnace system while performing as a fireplace for solid fuel combustion. It utilizes the heat generated by the solid fuel fire to heat not only the room in which it is located, but other spaces in the building. The unit may be installed without extensive structural modifications to provide a highly decorative and functional, relatively inexpensive, self-contained system.

Numerous other advantages and features of the present invention will become readily apparent from the following detailed description of the invention and of the disclosed embodiments thereof, from the claims and from the accompanying drawing in which each and every detail shown is fully and completely disclosed as a part of this specification in which like numerals refer to like parts.

DESCRIPTION OF PREFERRED EMBODIMENTS

Figure 1:
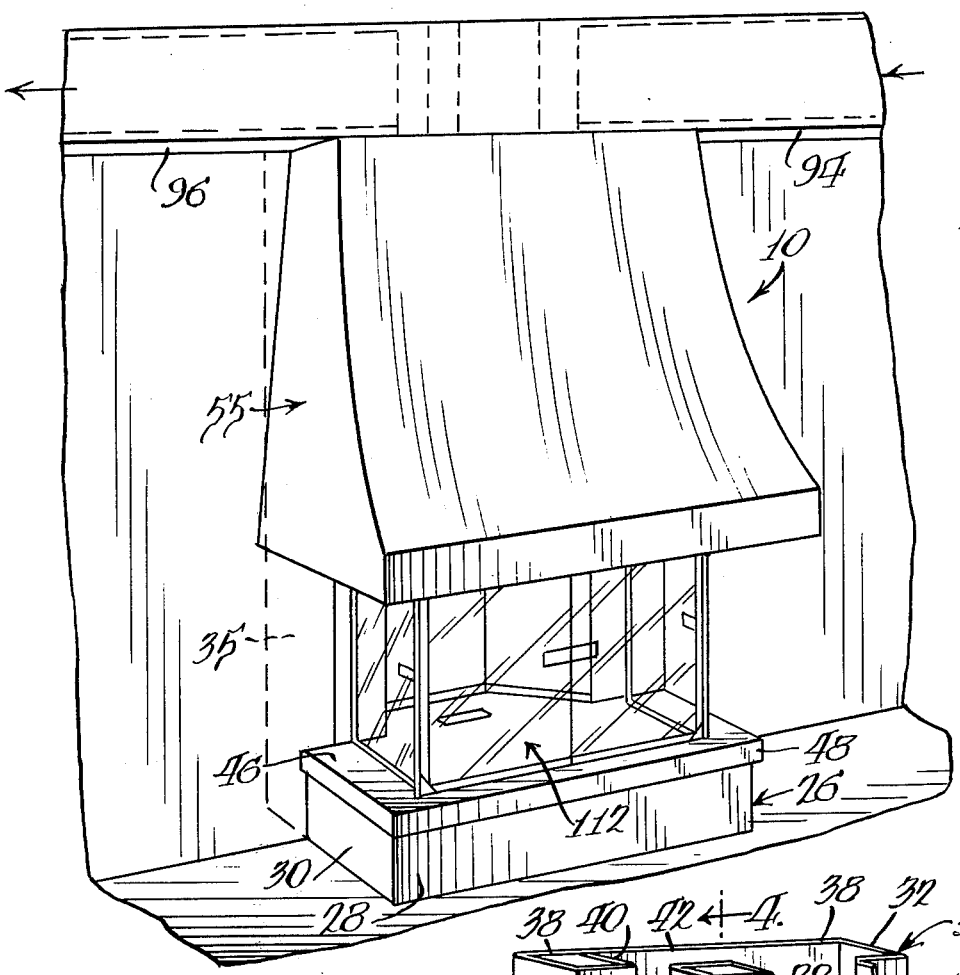
FIG. 1 is a perspective view of one embodiment of a self-contained unit of the present invention.
Figure 2:
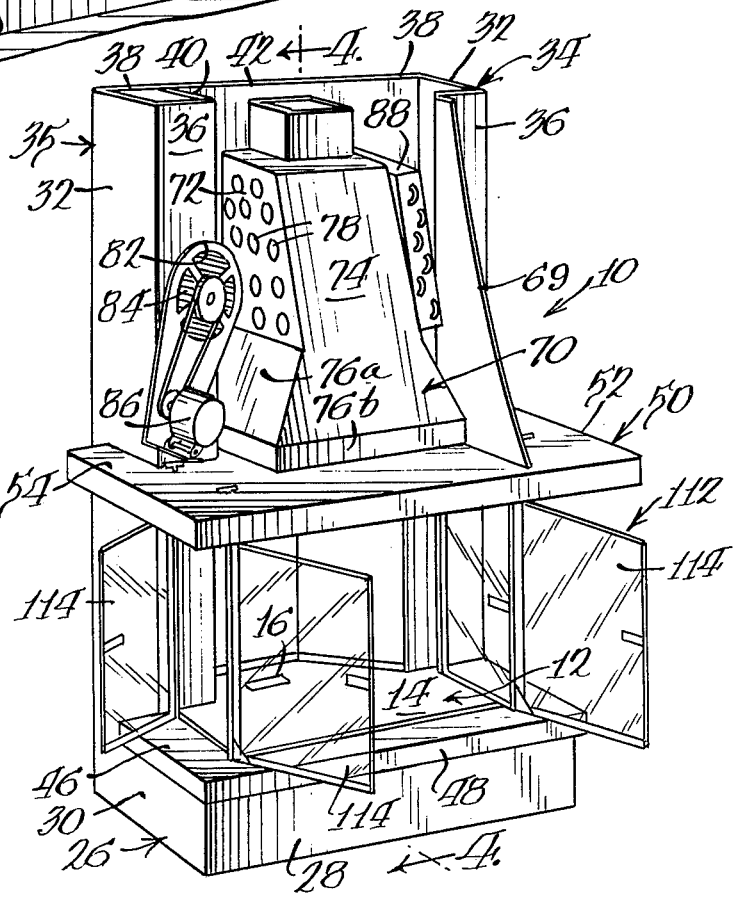
FIG. 2 is a perspective view with portions removed to show various components.
Figure 3:
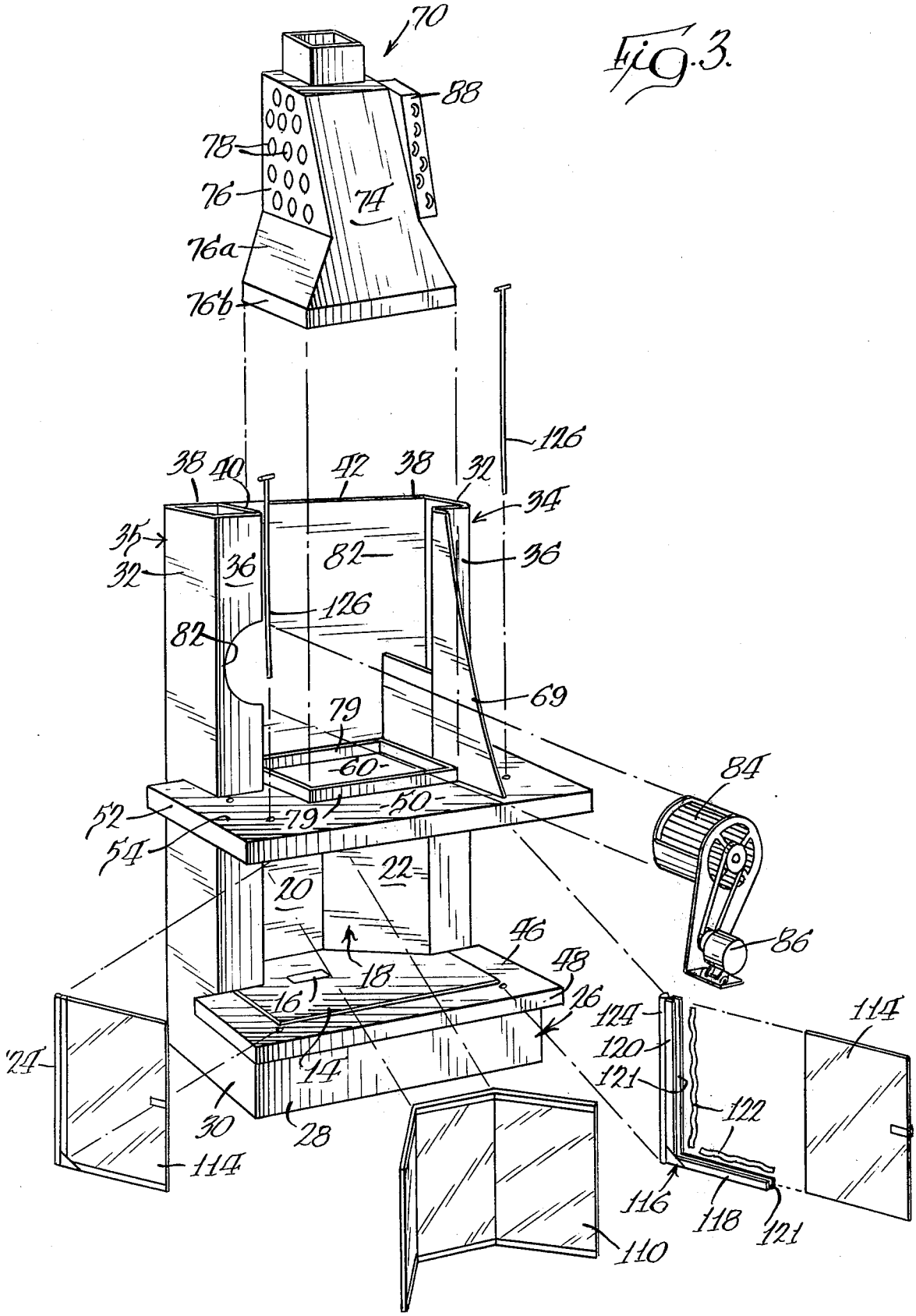
FIG. 3 is an exploded view.

While this invention is susceptible of embodiment in many different forms, there is shown in the drawings and will herein be described in detail a preferred embodiment of the invention and modifications thereof, with the understanding that the present disclosure is to be considered as an exemplification of the principles of the invention and is not intended to limit the invention to the embodiments illustrated. The scope of the invention will be pointed out in the appended claims.

The fireplace furnace unit incorporating the present invention is preferably totally self-contained and is preferably produced from components designed to permit assembly of the unit at the site of the installation. This approach, permits selection of components that allows for adaptation and customizing of the unit for individual installations.

Most if not all of the structural components of the unit are constructed of sheet metal. The use of sheet metal is feasible because the configuration of the unit thermally isolates the fire box from the surrounding environment, as explained below. Sheet metal components are desirable in that the resulting unit is relatively light weight and can be installed within a living area without the necessity of significant modifications or additional bulky insulation.

The unit 10 takes the form of a fireplace and includes a fire box 12, formed by a firebase or baseplate 14 for supporting solid fuel combustion materials. The baseplate 14 includes a forward generally rectangular portion **14*a* and a central generally trapazoidal projection 14*b* extending rearwardly therefrom. One or more apertures 16 may be formed in the baseplate 14** for use as an ash drop and/or as an inlet for combustion air from a source externally of the room in which the unit is located.

A fire wall 18, formed of three generally planar sections, a center section, the fire back 20, and a pair of side sections, the covings 22, extends upwardly from the peripheral edges of the trapazoidal projection **14*b* of the base plate 14. The base plate 14 is coated with a heat resistant ceramic material 24 suitable for use in supporting a solid fuel fire in the fire box 12**.

The base plate 14 forms the top of a hollow equipment compartment or support base 26 having a front generally rectangular planar panel 28 extending downwardly from the forward edge of the base plate 14 and a pair of side panels 30. That portion of the side panels 30 extending along the sides of the forward rectangular portion of the firebase merge with or may be extensions of the outer sidewalls 32 of a pair of hollow air columns 34, 35 that rise from either side of the trapazoidal projection **14*b***.

The air columns 34, 35 are constructed of sheet metal and each includes, in addition to outer sidewall 32, a front wall 36, a rear wall 38 and an inner sidewall 40, all of which extend the full height of the air columns 34, 35 from a level substantially co-planar with the base plate 14 to the top of the unit 10, although the outer sidewalls 32 and the back walls 38 may extend to the bottom of the support base 26 to form a portion of the sides thereof. The forward portion of the inner sidewalls 40 and the inner portion of front walls 36 of the air columns 34, 35 terminate at the top of the corresponding covings 22; the forward portion of each of the covings forming a wall **22*a* for that portion of the air columns 34** disposed adjacent thereto.

The rear walls 38 of the air columns 34, 35 are disposed in a plane rearwardly offset from the plane of the fire back 20 and a generally planar back plate 42 extends between and is generally co-planar with the rear walls 38 of the air columns 34, 35. As can be seen, the air columns 34, 35 and the space 44 between the fire back 20 and the back plate 42 define insulating air spaces which thermally insulate the fire box 12 from the surrounding environment. A generally U-shaped apron 46 may be disposed around the forward portion of the base plate 14 to define in conjunction therewith, a hearth. The apron 46 may be formed integrally with the base plate. A depending decorative skirt 48 is affixed to the peripheral edges of the apron 46 to enhance the appearance of the unit.

A generally U-shaped mantel 50 defines the top of the fire box 12. The peripheral edges of the mantel are generally vertically aligned with the peripheral edges of the apron 46. The legs 52 of the mantel include extensions 54 which project back along and are attached to the outer side walls 32 of the air columns 34, 35 to provide a support for a decorative hood 55 detachably supported on the mantel 50. The inner peripheral edges 58 of the legs 52 of the mantel 50 extend along the inner walls 40 of the air columns 34 and 35 to define a generally rectangular open top or exhaust opening 60 for the fire box 12.

A smoke shelf 62 is disposed above the fire box 12. The forward edges of the smoke shelf 62 are generally parallel to but offset forwardly from the fire back 20 and the covings 22. The smoke shelf 62 is generally triangular in cross section and includes a horizontal top 64, the shelf 62 being co-planar with the bottom of the mantel 50 and a tapered front wall 66, extending down to merge with the corresponding sections 20, 22 of the fire wall 18. The top 64 of the smoke shelf 62 extends to the back plate 42, and may include an aperture 68, for reasons discussed below.

Above the mantel 50, the inner sidewalls 40 of the air columns 34, 35 may incorporate a forwardly extending generally triangular portion 69 (only one being shown) adapted for connection to and support of the mantel 50 and the decorative hood 55.

An exhaust duct 70 is disposed between the air columns 34, 35 and is supported over the open top 60 of the fire box 12. The exhaust duct 70 includes a back wall 72, a rearwardly tapered front wall 74 and a pair of generally trapazoidal sidewalls 76. The lower portions **76*a* of the sidewalls 76 taper outwardly to merge with a bottom portion 76*b* which fits over raised flanges 79 rising from the periphery of the exhaust opening 60**.

The sidewalls 76 of the exhaust duct 70 are each provided with a plurality of aligned apertures 78 interconnected by hollow heat exchanger tubular members 80. The heat exchanger tubes 80 are positioned to be heated by a fire in the fire box 12 for the purpose of transmitting heat to air passing through the tubes 80.

Openings 82 are formed in the inner sidewalls 40 of each of the air columns 34, 35 at a location adjacent to the opposite ends of the heat exchanger tubes 80. A fan 84, driven by a motor 86, is positioned in one of the openings 82 in air column 35 and circulates air through the air columns 34, 35 and the heat exchanger tubes 80.

Air cooling coils 88 may be located immediately adjacent one end of the heat exchanger tubes 80. The compressor (not shown) may be located in any convenient location, e.g., in the support base or outside the building. The condenser may also be located outside, or alternatively within the air space 44, in the path of air flowing through air space 44. A supplemental heater, such as a plurality of gas burners 90, is disposed immediately above exhaust opening 60 and below the heat exchanger tubes 80. The burners are mounted on protective plates 92 which, in turn, are supported on and affixed to the flanges 79. The plates 92 protect the burners 90 from direct exposure to a fire in the fire box 12.

In the embodiment disclosed in FIGS. 1–7, air column 34 is a return air duct and the air column 35 is an air supply duct. The portion of the air columns 34, 35 below the mantel 50 may be isolated from that portion above the mantel by suitable partition (not shown). The air is returned to the unit from air return ducting 94 in the building (See FIG. 1) through the return air duct 34, is passed through the heat exchanger tubes 80 and is supplied to air distribution ducting 96 (See FIG. 1) in the building through the air supply duct 35. With a fire in the fire box or when the gas burners are lit, the air passing through the heat exchanger tubes 80 is heated as with any forced air furnace, and forms part of a forced air system for heating the building in the usual manner.

Combustion may be controlled by controlling the supply of air to the fire and/or to the burners through the supply of air to the fire and/or to the burners through the inlet 16 in the base plate 14.

The hollow support base 26 is supplied with air from a source externally of the room in which the unit 10 is located through an inlet 98 connected through the rear wall or back plate 42 below the level of the base plate 14.

A damper in one of the inlets 16, 98 which may be manually or thermostatically controlled, governs the amount of air passing through the inlet 16 and thereby controls the intensity of combustion of the fire in the fireplace or of the gas burners. If desired, the supply of gas to the burners may be varied to correspond to the amount of combustion air being supplied through the inlets.

Figure 4:
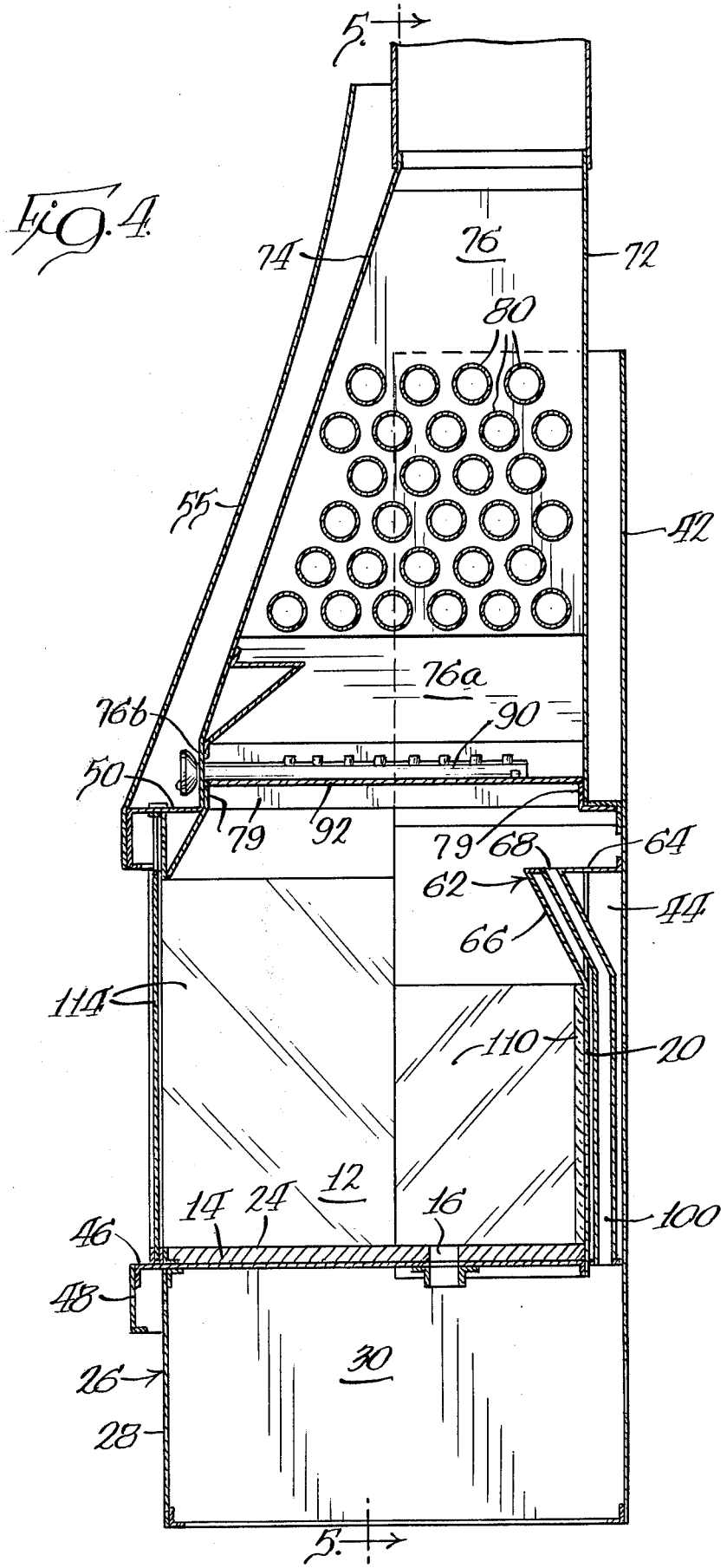
FIG. 4 is a sectional view taken along lines 4—4 of FIG. 2.
Figure 5:
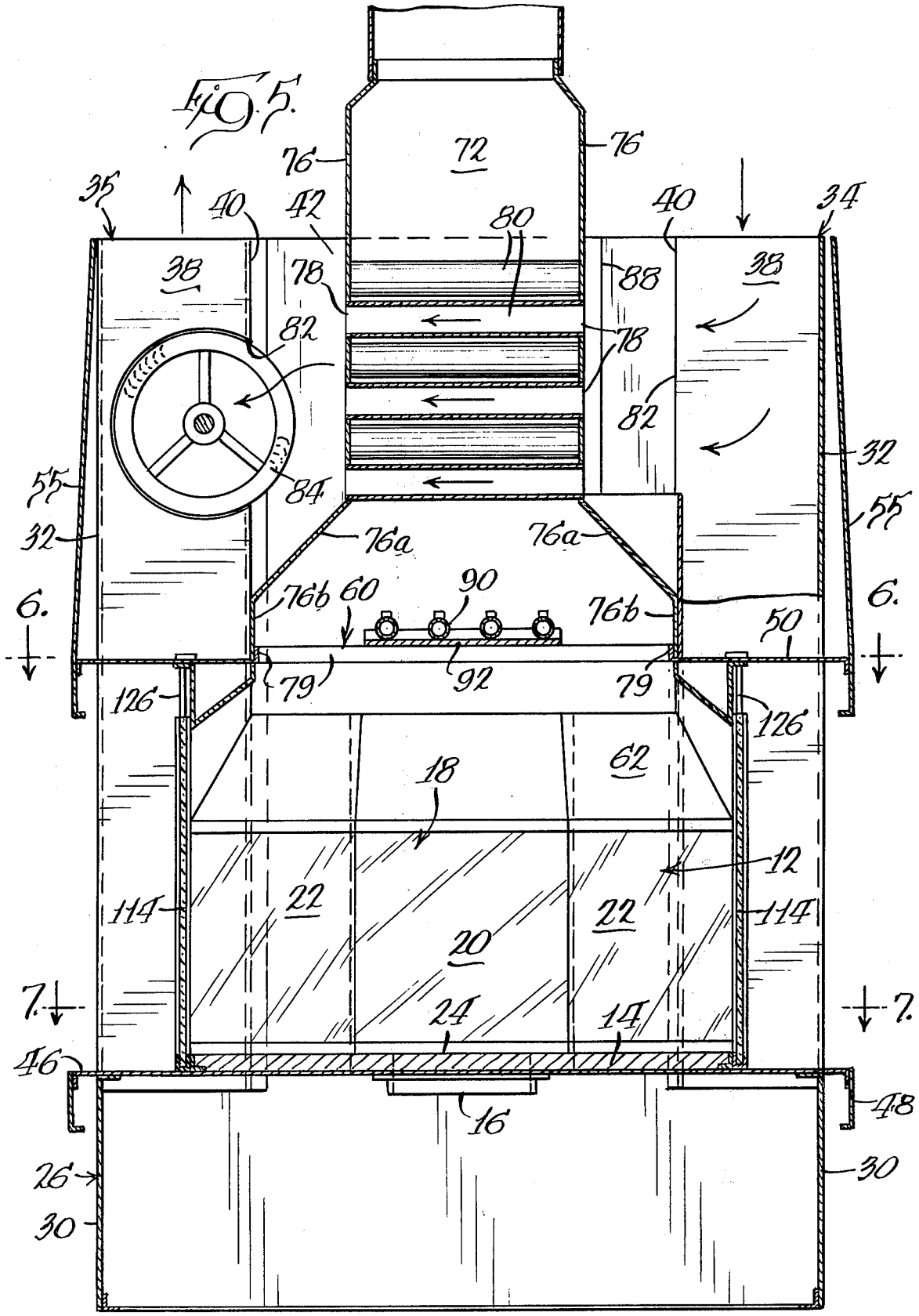
FIG. 5 is a sectional view taken along lines 5—5 of FIG. 4.
Figure 6:
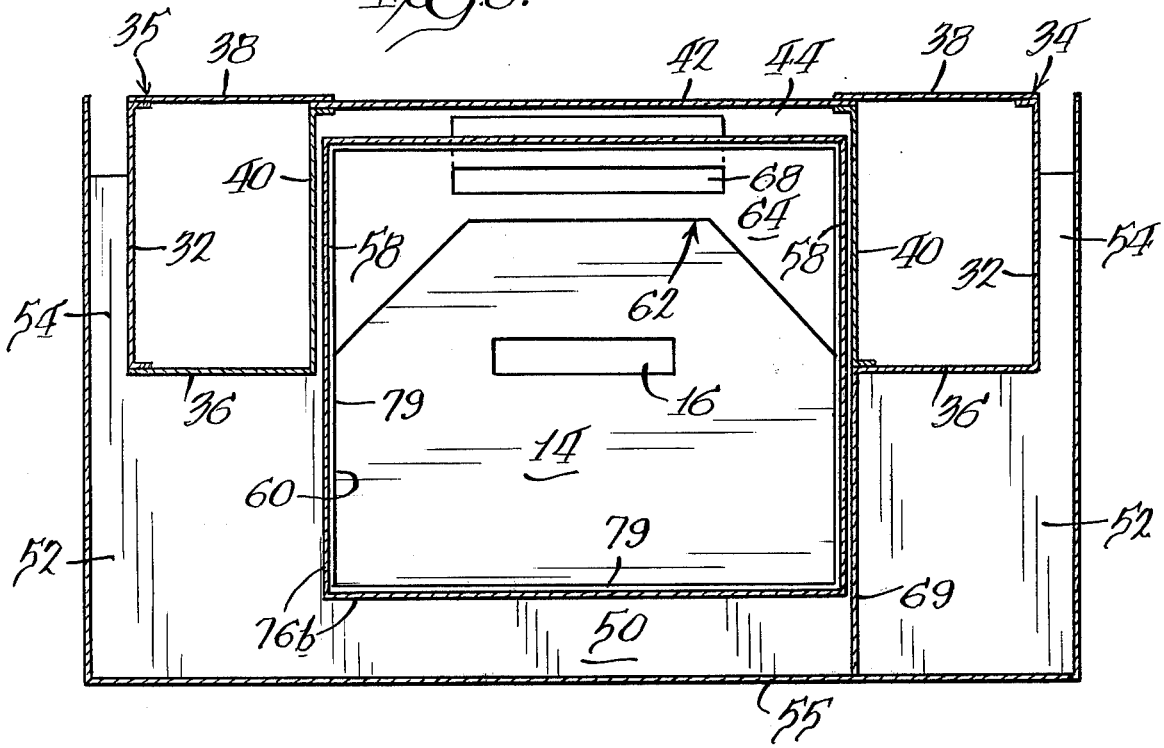
FIG. 6 is a sectional view taken along lines 6—6 of FIG. 5.
Figure 7:
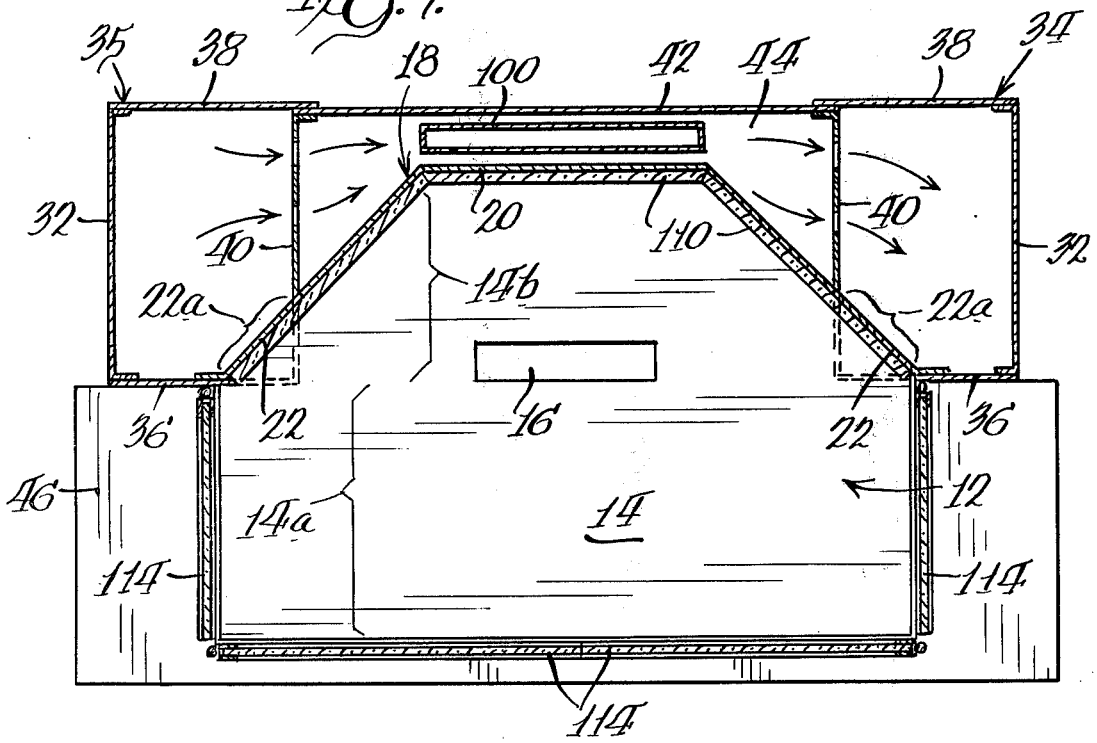
FIG. 7 is a sectional view taken along lines 7—7 of FIG. 5.

A fan (not shown) may be disposed within the support base 26 to divert some of the air received from the external source up into the space 44 between the fire wall 18 and the back plate 42 to improve the thermal insulation between the fire box 12 and the surrounding environment. As indicated above, a condensor (not shown) may be disposed in this space to intercept the air flowing therethrough which exhausts at one of two locations, at the top of the fire box 12 immediately below the exhaust duct 70 or at the top of the exhaust duct immediately above the heat exchanger 80. As shown in FIG. 4, a conduit 100 extending through space 44 between the support base 26 and the opening 68 in the top wall 64 of the smoke shelf 62, may be used to assist exhaust of combustion exhaust products for the unit.

Figure 8:
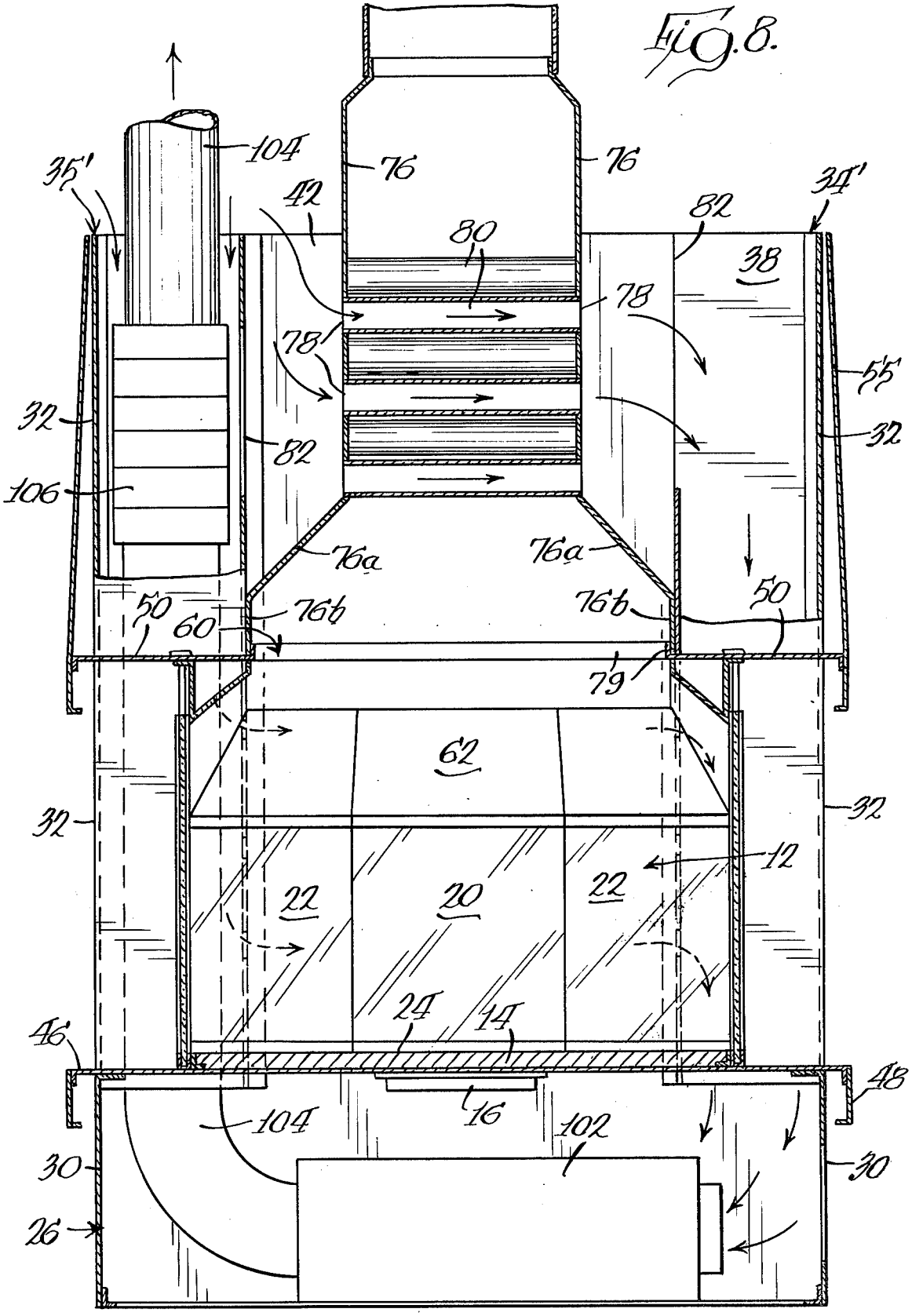
FIG. 8 is a sectional view, similar to FIG. 5, of an alternative embodiment.

In the alternative embodiment shown in FIG. 8, a supplemental heater for the circulating air is provided by an independent unit such as the system marketed by Punham Bush, Inc. of Harrison, Va. under the trademark SPACE-PAK. In this embodiment, compressor and blower unit 102 is located within the support base 26. An air supply duct 104 rises from the support base 26 through one of the air columns 35'. Electric heaters 106 are installed as a part of the supply ducting 104. Return air passes through the upper portion of both air columns, 34', 35'. In air columns 35', return air passes around the supply duct 104 and portions pass through the heat exchanger tubes 80 and then down the other column 34' to the blower unit 102. Some of the air passing through air column 35' also passes laterally behind the fire back 62. An additional fan may be used to control the supply of combustion air to the fire box and the exhaust through the conduit 100 in space 44 behind the fire wall 18.

The decorative aspect of the unit 10 of the present invention as well as improved heat transfer into the room in which the unit 10 is located is enhanced by a highly reflective mirrored fire wall insert 110 which is adapted to be affixed to the firewall 18. Since fire in the fire box 12 is partially set into the room, the mirrored insert provides a startling panorama of reflected and re-reflected images of the fire.

The open front and sides of the fire box 12 are enclosed by a plurality of decorative transparent doors 112 which include a pair of doors on either side of the fire box and a pair of doors traversing the front of the fire box. Each of the doors 112 comprises a transparent pane 114, which may be constructed as required of a suitable transparent material such as heat treated and/or tempered glass.

Each of glass panes 114 is supported in an L-shaped frame 116. Each frame includes a horizontal leg 118 and a vertical leg 120 each defining an open channel 121 adapted to receive a corresponding edge portion of the glass pane 114. The glass pane is retained within each channel 121 by a serpentine flat spring 122 disposed between one side of the channel 121 and the glass pane 114 to resiliently retain the pane in place. This contruction allows for the necessary expansion and contraction of the components when exposed to the various temperatures.

Each of the doors 112 is pivotally supported by a hinge tube 124 formed on the back of the vertical leg 120 of each door frame 116. A slightly curved rod or hinge pin 126 extends through the mantel 50 through the hinge tube 124 and into the base plate 14 to pivotally support each door 112 in place and permit each of the doors to be positioned in any desired orientation.

Thus there has been disclosed a self-contained fireplace air circulating system capable of providing the functions of a fireplace, the forced air furnace and of an air conditioner. The Unit of the present invention can be installed within the living space of the building, has a decorative appearance of a fireplace while simultaneously providing the necessary air heating and cooling functions of forced air furnace system. It requires little if any structural modifications or special supports, it is safe and improves the utilization of the energy for forced air heating within the building.

From the foregoing, it will be observed that numerous variations and modifications may be effected without departing from the true spirit and scope of the novel concept of the invention. It is, or course, intended to cover by the appended claims all such modifications as fall within the scope of the claims.

What is claimed is:

1. A self-contained modular fireplace and circulating air unit for installation in a building living area comprising:

(a) a plurality of modules defining a combustion system and an air circulating system functionally isolated from said combustion system and including:

(a-1) a sheet metal base member adapted to be supported by a floor in the building living area;

(a-2) a pair of spaced apart vertically extending sheet metal ducts supported by said base member, each of said ducts defining an air column, said air columns rising from the rear corner portions of said base member;

(a-3) a mantel supported between said air columns and extending forwardly therefrom, said mantel being spaced above the upper surface of said base member to define a fire box area therebetween and including an aperture defining an exhaust opening for said fire box;

(a-4) a fire back module disposed between and affixed to said air columns and extending between said support base and said mantel;

(a-5) an external generally planar back member extending between said air columns and spaced rearwardly of said fire back module to define an insulating air space therebetween; and (a-6) heat exchanger means disposed above and in communication with said exhaust opening to intercept exhaust products of combustion from said fire box for transferring heat from said combustion exhaust to said heat exchanger;

(b) said combustion system including said fire box and said heat exchanger means;

(c) said circulating system including at least a part of said air columns defining circulating air ducts with portions of said circulating air ducts located adjacent to, on either side of, and in communication with said heat exchanger means and extending upwardly from said location adjacent said heat exchanger means for connection to air distribution ducting forming a part of the building in which said unit is disposed; and (d) blower means for circulating air through said circulating air ducts and through said heat exchanger means for transferring heat between said heat exchanger and the air in said circulating air ducts;

whereby said building may be heated by air passing through said air circulating system through said building duct work.

2. A unit as claimed in claim 1 including:

an exhaust duct disposed above and in communication with said exhaust opening for receiving said combustion exhaust products and for directing said combustion exhaust products to an exhaust flue;

said exhaust duct incorporating said heat exchanger means.

3. A unit as claimed in claim 2 including:

a smoke shelf means disposed in said exhaust duct.

4. A unit as claimed in claim 2 wherein:

said rear insulating space communicates with said exhaust, whereby air passing through said rear insulating space may be exhausted with said combustion exhaust.

5. A unit as claimed in claim 2 wherein:

said rear insulating space is connected to said exhaust above said heat exchanger means, whereby air flowing through said rear insulating space bypasses said heat exchanger means.

6. A unit as claimed in claim 2 wherein:

said rear insulating space is connected to said exhaust duct at a position adjacent to the upper end of said fire box, whereby air flowing through said rear insulating space intercepts said heat exchanger means.

7. A unit as claimed in claim 1 including:

additional heating means disposed in said combustion system for effecting heating of said heat exchanger means.

8. A unit as claimed in claim 7 wherein:

said additional heating means is disposed immediately below said heat exchanger means; and including means for protecting said additional heating means from combustion products exhausted from said fire box.

9. A unit as claimed in claim 8 wherein:

said additional heating means includes a plurality of gas burner means.

10. A unit as claimed in claim 1 in which said circulating air blower means is disposed in said circulating air ducts adjacent to said heat exchanger means.

11. A unit as claimed in claim 1 wherein:

said circulating air ducts comprise an air supply duct and an air return duct, said ducts being located on opposite sides of said heat exchanger means, the portions of said ducts located adjacent to said heat exchanger means defining apertures in communication with said heat exchanger means for directing air circulating in said air return duct through said heat exchanger means into said supply duct.

12. A unit as claimed in claim 11 wherein:

said air columns extend downwardly from said heat exchanger means on either side of said fire box for thermally insulating the sides of said fire box from the surrounding living area and said air columns extend upwardly from said heat exchanger means to a position adjacent the upper extremities of said unit, the upper end of said air columns being adapted for connection to air distribution ducting forming a part of the building in which said unit is disposed.

13. A unit as claimed in claim 12 including:

said supply air duct and said return air duct are in communication through said insulating air space behind said fire box, whereby air passes between said air ducts through said air space.

14. A unit as claimed in claim 1 including:

a decorative hood detachably secured to said unit above said fire box and enclosing said heat exchanger means, said hood having a front wall and sidewalls extending rearwardly from said front wall, whereby removal of said hood provides access to said heat exchanger means and said blower means.

15. A unit as claimed in claim 1 including:

a reflective fire wall insert affixed to said fire wall.

16. A unit as claimed in claim 1 including:

a plurality of fire doors enclosing portions of said fire box;

said doors being pivotally attached to said unit to permit selective positioning thereof in a plurality of orientations.

17. A unit as claimed in claim 16 wherein:

each of said fire doors includes a transparent pane portion and a support frame portion, and hinge pins for pivotally attaching said frame portion to said unit.

18. A unit as claimed in claim 17 wherein:

each of said frame portions includes a generally longitudinal channel-shaped leg and a generally vertical channel-shaped leg having one end connected to one end of said horizontal leg portion;

said legs supporting said pane in said channels.

19. A unit as claimed in claim 18 including bias means disposed in said channel for frictionally retaining said panes in said channels.

20. A unit as claimed in claim 1 wherein:

said air columns extend downwardly below said heat exchanger means on opposite sides of said fire box to define insulating air spaces between said fire box and the exterior of said unit.

* * * * *